United States Patent [19]

Johns

[11] 4,359,209

[45] Nov. 16, 1982

[54] HOT AIR LADLE PREHEAT STATION AND METHOD

[75] Inventor: James E. Johns, Upper St. Clair Township, Allegheny County, Pa.

[73] Assignee: Bloom Engineering Co., Inc., Pittsburgh, Pa.

[21] Appl. No.: 337,446

[22] Filed: Jan. 6, 1982

[51] Int. Cl.[3] ..... F27B 14/14

[52] U.S. Cl. ..... 266/44; 75/46; 266/141; 266/901; 432/225

[58] Field of Search ..... 266/44, 141, 901; 432/225, 237, 224; 75/46

[56] References Cited

U.S. PATENT DOCUMENTS 4,223,873 9/1980 Battles ..... 266/44

4,229,211 10/1980 Battles ..... 75/46

*Primary Examiner*—L. Dewayne Rutledge

*Assistant Examiner*—Christopher W. Brody

*Attorney, Agent, or Firm*—Webb, Burden, Robinson & Webb

[57] ABSTRACT

The hot air ladle preheat station comprises an outer casing defining an opening for receiving a separately supported ladle. The opening is dimensioned so as to form a dilution air space about the ladle exterior. A wall is spaced inward of the outer casing and defines a space therebetween having a lower section for accommodating the ladle in spaced apart relationship from the wall and an upper flue section. Stack means are positioned for exiting flue gas from the upper flue section. A burner means is associated with the wall in the lower section for directing a flame into the ladle and a recuperator means cooperates with the upper flue section. Products of combustion are directed into the ladle and exit from the ladle in the space formed with the wall. The products of combustion mix with and are cooled by the outside air entering through the dilution air space and the mixture thus formed passes through the recuperator in heat exchange relationship with combustion sustaining gas utilized in the burner means.

13 Claims, 3 Drawing Figures

HOT AIR LADLE PREHEAT STATION AND METHOD

FIELD OF THE INVENTION

My invention relates to ladle heating apparatus and method and, more particularly, to a hot air ladle preheat station and method of utilizing spent products of combustion for heating the combustion sustaining gas such as air directed to the ladle burner for mixing with the fuel.

BACKGROUND OF THE INVENTION

In the production of ferrous and nonferrous metals, it is common to employ refractory lined ladles to receive the molten metal during and after the various refining stages. These ladles are recycled and normally require preheating of the refractory lining between uses. In addition, new linings require drying out as do linings which have been repaired through patching.

Early systems of ladle drying and/or preheating involve merely placing a burner head in a ladle and firing away, but such systems were inefficient and energy wasteful. Cold air preheat stations have also been utilized but again the present cost of energy makes such systems expensive and impractical to operate.

Recuperation has also been used in ladle preheat stations. One such early system is disclosed in Widekind U.S. Pat. No. 1,057,905 where a ladle is turned upside down to form a seal against the heating station. More sophisticated ladle heating systems are disclosed in U.S. Pat. Nos. 4,223,873 and 4,229,211. All of these systems which use recuperation and based on proper sealing of the lip of the ladle to the ladle heating apparatus. The problem associated with these systems is that a tight seal between the lip of the ladle and the ladle heating apparatus is necessary to define a closed system within which the recuperators operate. In practice, the seal is difficult to achieve because the lip of the ladle is normally covered with solidified chunks of metal and other types of slag which disrupt the seal and/or cause damage to the sealing surface on the ladle heating apparatus. In addition, the systems normally require high temperature recuperators such as ceramic and separately run dilution air fans to provide a coolant for the products of combustion so as to prevent overheating of the recuperators.

Finally, other sophisticated systems have been developed for ladle preheating such as that disclosed in U.S. Pat. Nos. 4,106,755 and 4,190,235, both of which require fluidized bed technology to improve fuel efficiency.

SUMMARY OF THE INVENTION

I have developed a hot air ladle preheat station which utilizes recuperation but which totally eliminates the need to create any seal. This design therefore eliminates the maintenance of any seal between the ladle and the burner wall. In addition, my preheat station and method utilizes ambient air drawn in around the periphery of the ladle as dilution air to cool the products of combustion prior to recuperation and thus permit the employment of recuperators of standard materials rather than the expensive, high temperature materials employed in closed systems. This, therefore, avoids the need for separate dilution air fans which have been employed heretofore.

My hot air ladle preheat station comprises an outer casing defining an opening for receiving a separately supported ladle. The opening is dimensioned so as to form a dilution air space about the ladle which permits ambient air to be drawn in therearound. A wall is spaced inward of the outer housing to define a space therebetween. The space includes a lower section for accommodating the ladle in spaced apart relationship from the wall and an upper flue section for engagement with a stack means for exiting the flue gas. Burner means are associated with the wall in the lower section for directing the flame into the ladle. A recuperator means cooperates within the upper flue section. A ladle stand supports the ladle, preferably in a horizontal position. The burner means directs a flame into the ladle and the products of the combustion exit the ladle and mix with the dilution air prior to passing in heat exchange relationship through the recuperator with the air or other combustion sustaining gas directed to the burner means.

DESCRIPTION OF THE PREFERRED EMBODIMENTS

Figure 1:
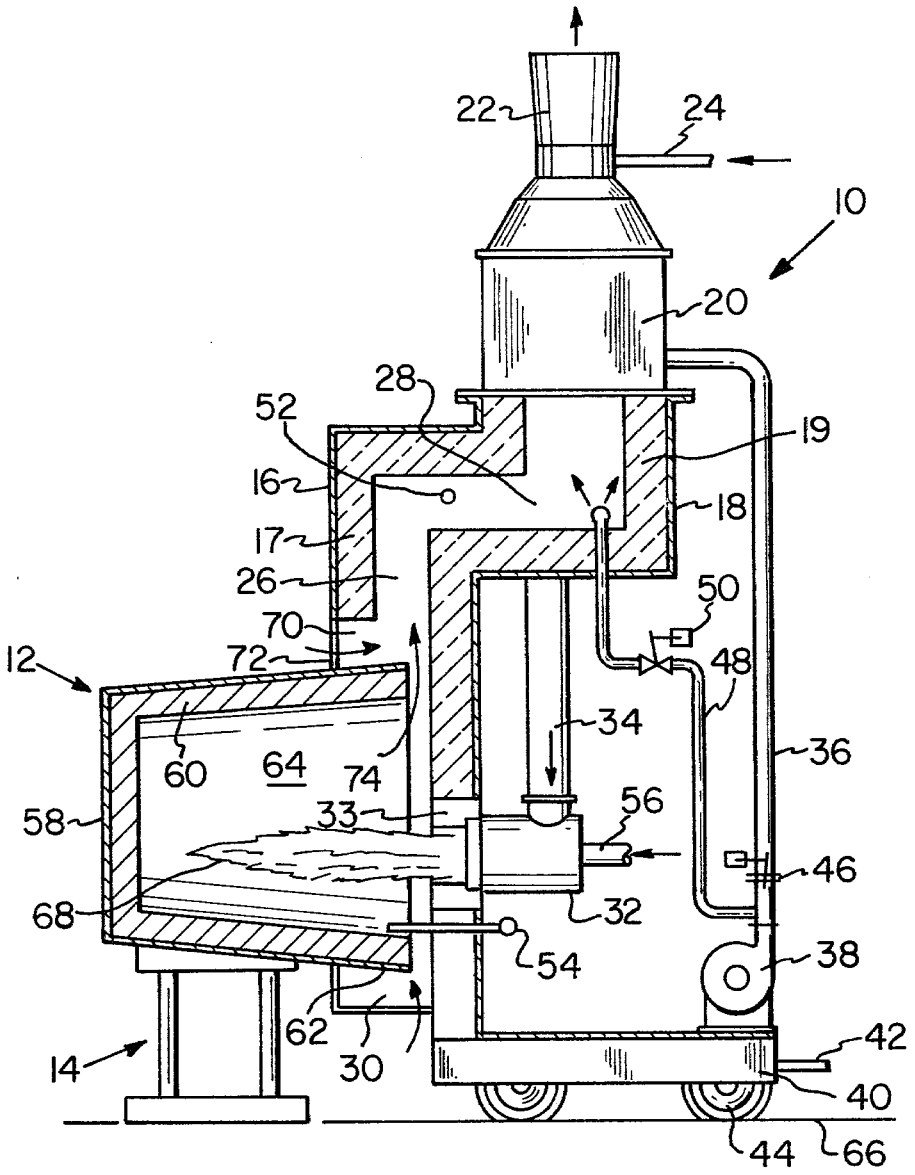
FIG. 1 is a schematic of a section taken along a vertical plane through the hot air ladle preheat station.
Figure 2:
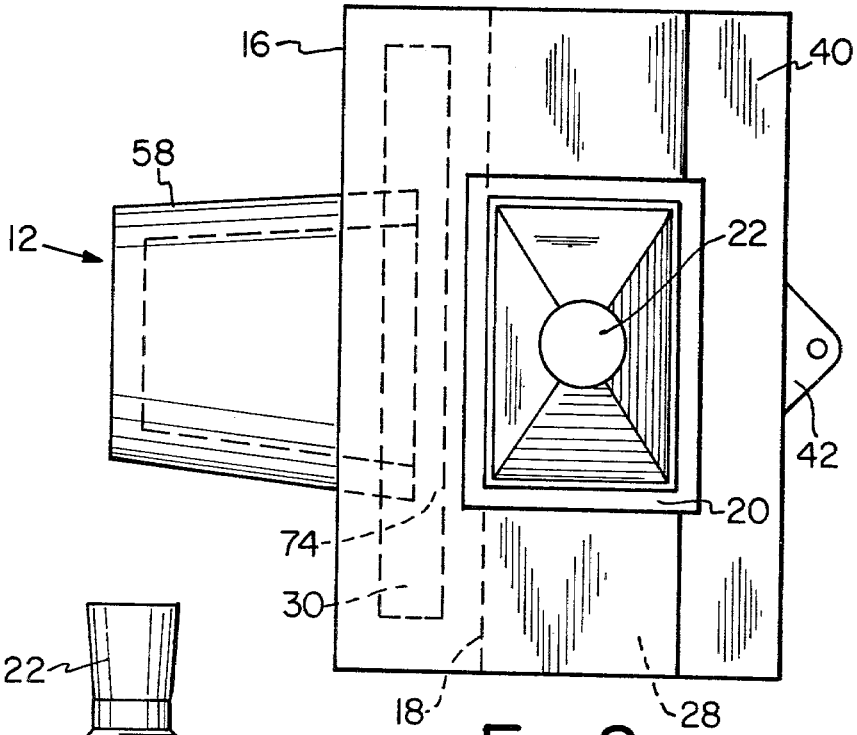
FIG. 2 is a plan view of the hot air ladle preheat station.
Figure 3:
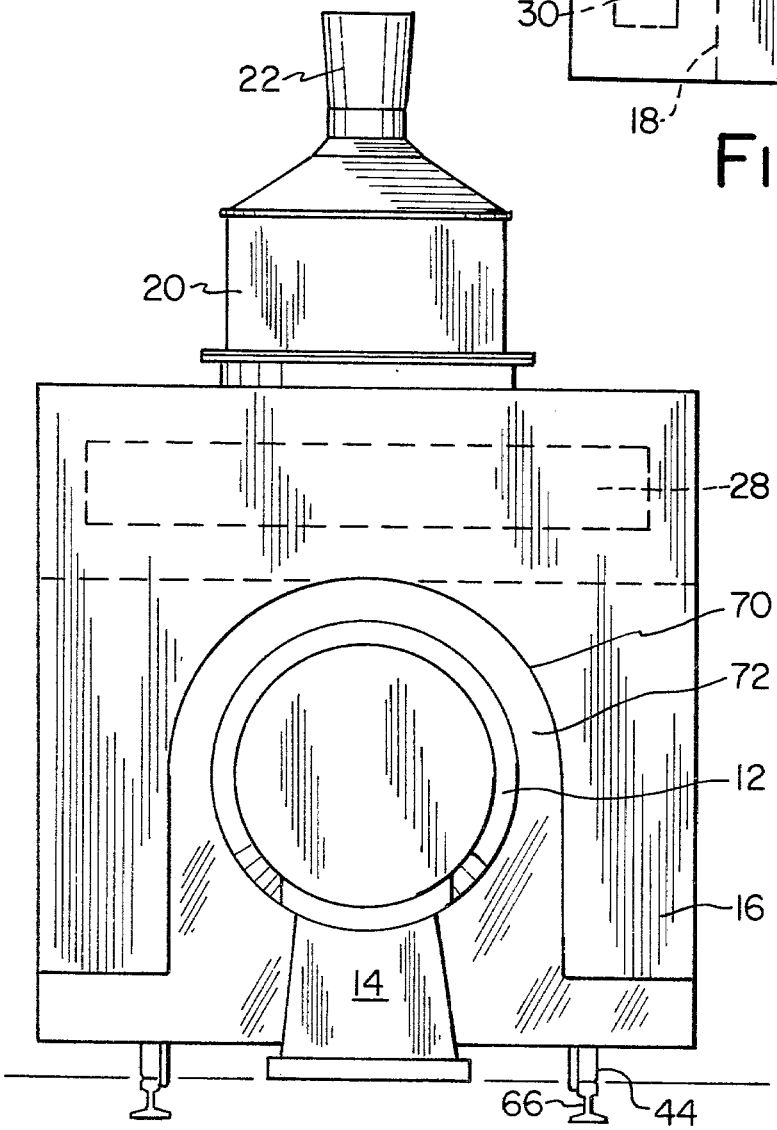
FIG. 3 is an end view of the hot air ladle preheat station.

My hot air ladle station, generally designated 10, is used in conjunction with a ladle 12 which is horizontally positioned on a ladle stand 14, FIGS. 1–3. It is also possible for the ladle to be positioned other than horizontally but the horizontal position is the presently preferred position. The ladle station 10 is mounted on wheels 44 which engage track 66 so that the ladle station 10 can be moved into and out of position with respect to the stand 14 which is normally at a fixed location.

The hot air ladle station 10 comprises a main frame or base 40 onto which wheels 44 are mounted. A shroud or outer casing 16 is mounted on the main frame 40 and a wall 18 is spaced inward therefrom and likewise mounted to main frame 40. An attachment lug 42 connects to the main frame to receive an appropriate coupling means for moving the station 10. Outer casing 16 includes an inner refractory lining 17 and wall 18 includes an inner refractory lining 19. A plenum 26 is formed between the casing 16 and wall 18.

The plenum 26 is divided into two sections, namely a lower section 30 and an upper flue section 28. A large opening 70 in the casing 16 provides access to the lower plenum section 30. The flue section 28 is in registry with a recuperator 20 mounted atop the casing 16 and wall 18 and a stack 22 is mounted atop the recuperator 20. An air ejector 24 feeds into the stack 22 and is driven by a forced air fan (not shown) so as to overcome the pressure resistance across the recuperator and provide an adequate draw.

A burner 32 is mounted to the backside of wall 18 so as to direct a flame 68 through an opening 33 in said wall 18 and into a properly positioned ladle. A fuel duct 56 extends into the rear of the burner 32 and a hot air duct 34 extends from the burner 32 into the recuperator 20. A combustion sustaining gas such as air is brought into the system by a blower 38 and is directed through a cold air duct 36 into recuperator 20 where it is heated prior to entering hot air duct 34 as will be described hereinafter.

A cold air safety duct 48 likewise connects to cold air duct 36 in the area of the blower for directing cold air into the flue section 28. A control motor and flapper valve 46 are connected into the cold air line 36 and an on-off valve 50 is connected into the safety duct 48. A burner control thermocouple 54 or other type of temperature measuring device extends through the wall 18 in the area of the burner 32 and an overtemperature thermocouple 52 is positioned in the flue section 28.

The ladle 12 includes an outer casing 58 and an inner refractory lining 60. The inner lining 60 defines the ladle interior 64. The ladle terminates at a lip or rim 62. The ladle stand 14 can be of any conventional design and the details of the ladle stand do not form a part of this invention.

Prior to moving the ladle station 10 into position, the ladle 12 is positioned horizontally on the ladle stand 14. Thereafter, the ladle station 10 is moved into position so that the ladle extends through the casing opening 70 into the lower section 30 of the plenum 26 but well short of the refractory lining 19 of the wall 18. As positioned, a dilution air space 72 is formed between the ladle shell 58 and the ladle station casing 16. The air space 72 can completely surround the ladle or can partially surround it as shown in FIG. 3. Preferably, at least the upper half of the ladle should be surrounded by the air space 72. Likewise, a products of combustion space 74 is formed between the ladle lip 62 and the refractory 19 of wall 18.

In operation, the flame 68 is directed into the ladle interior 64 so as to heat the ladle lining 60. The products of combustion exit the ladle interior 64 through the space 74 and pass upward into the flue section 28 of the plenum 26. Ambient dilution air is drawn through the dilution air opening 72 so as to mix with the products of combustion. This mixture passes through the recuperator 20 in heat exchange relationship to cold air which is entered into the recuperator 20 through cold air duct 36. The cold air is then heated by the products of combustion and dilution air mixture and passes into hot air duct 34 so as to provide the combustion sustaining gas for the burner 32. The forced air into ejector 24 exits the stack thereby providing the necessary draw for the dilution air and products of combustion which likewise pass through the stack 22. The recuperator can also be positioned lower in the plenum so that the gases are drawn down through the recuperator rather than up through as illustrated.

While the air ejector is one means of achieving adequate draw across the recuperator, it will be recognized that other means are also available. For example, by controlling the stack height or through the use of a low resistance recuperator an air ejector may not even be needed.

A number of control systems can be employed to operate the hot air ladle station. Under normal circumstances, the large quantity of dilution air entering the system is sufficient to adequately cool the recuperator 20 and prevent its overheating. For this reason alloy steel recuperators may be used rather than the high temperature ceramic recuperators required in other preheat ladle systems.

A safety overtemperature thermocouple 52 is positioned in the flue chamber 28 and when the temperature reaches a predetermined set point, the on-off valve 50 in the overtemperature safety duct 48 is activated so as to bring additional cold air into the system for further cooling the recuperator 20. The burner control thermocouple 54 which extends into the ladle 12 controls the heat input from the burner 32 into the ladle interior 64. The overtemperature thermocouple 52 can also be used to control the burner so that if the overtemperature thermocouple 52 rises to a set point, the burner 32 is cut back.

Ladle rim 62 is spaced with respect to the refractory 19 of wall 18 so as to give a uniform exit flow of the products of combustion. However, this spacing is not as critical as in conventional ladle stations where efficiency and heating time is dependent on the proper seal. In the extreme, if the ladle lip is pressed up against the refractory 19, the burner firing rate will be reduced because of the back pressure resisting the flame. If the ladle lip is positioned too far from the refractory 19 and wall 18, there is a poor distribution of heat, and the possibility that the products of combustion could exit the opening 72 and damage the ladle station 10. However, between these two extreme positions, the burner operates efficiently to cause uniform heating of the ladle lining 60 and the system draws in sufficient dilution air to cool the recuperator under normal circumstances. A normal range of exit flow of the products of combustion would be on the order of 25 to 40 feet/second hot velocity.

It can thus be seen that I have provided a hot air ladle station which totally eliminates the need for any seal between the ladle lip and the preheat station and I further eliminate the need for a separate dilution air fan since ambient air is drawn into the system by natural draft.

I claim:

1. A hot air ladle preheat station comprising:

A. an outer casing defining an opening for receiving a separately supported ladle, said opening dimensioned so as to form a dilution air space about the ladle;

B. a wall spaced inward of the outer casing and defining a space therebetween, said space having a first lower section for accommodating the ladle in spaced apart relationship with said wall and an upper flue section;

C. stack means for exiting flue gas from said upper flue section;

D. burner means associated with said wall and lower section for directing a flame into said ladle; and E. recuperator means cooperating with said upper flue section;

whereby products of combustion exit the ladle and pass upward mixing with and being cooled by dilution air drawn through said dilution air space and passing through the recuperator in heat exchange relationship for heating combustion sustaining gas directed to said burner means.

2. A hot air ladle preheat station of claim 1 including refractory lining on the interior of said wall and said casing.

3. A hot air ladle preheat station of claim 1, said casing and wall supported by a base section, said base section including wheels so as to make said station movable with respect to a ladle stand.

4. The hot air ladle preheat station of claim 1, said recuperator positioned atop said casing and wall.

5. The hot air ladle preheat station of claim 1 including a cold air duct leading into said recuperator, a hot air duct leading out of said recuperator to said burner means and a blower for directing air into said cold air duct.

6. The hot air ladle preheat station of claim 5 including a dilution air safety duct extending from said cold air duct into said upper flue section and valve means associated with said safety duct for directing cold air into said flue section.

7. The hot air ladle preheat station of claim 1 including an ejector air system connected to said stack to assist in drawing the dilution air and products of combustion through the flue section, the recuperator and out the stack.

8. The hot air ladle preheat station of claim 6 including temperature sensing means positioned in said upper flue section, said temperature sensing means connected to said valve means to supply dilution air when the temperature of the flue section exceeds a set point.

9. The hot air ladle preheat station of claim 1, said recuperator means comprising an alloy steel recuperator.

10. The air ladle preheat station of claim 1, said dilution air space surrounding at least an upper half of said ladle.

11. In combination:

A. a ladle stand;

B. a hot air ladle preheat station adjacent said ladle stand and including an outer casing having a ladle receiving opening, a wall spaced inward of the outer casing and defining a space therebetween, said space having a lower section in the area of said receiving opening and an upper flue section associated with a recuperator and an exit stack, said wall including burner means in said lower section;

C. a ladle horizontally mounted on said ladle stand and extending into said receiving opening and short of said wall so as to define a dilution air space between the ladle and the outer casing and a products of combustion space between a ladle rim and said wall;

whereby said burner means directs flame into said ladle, products of combustion exit the ladle through said products of combustion space and mix with dilution air prior to passing in heat exchange relationship through said recuperator with combustion sustaining gas directed to said burner means.

12. A method of heating ladles or the like comprising:

A. positioning a ladle horizontally in a hot air ladle preheat station short of a burner wall to define a dilution air entrance space about said ladle and a products of combustion exit space between a ladle rim and said burner wall;

B. directing flame into said ladle from burner means associated with said wall;

C. exiting products of combustion through said exit space;

D. mixing said products of combustion with dilution air from the entrance space to form an air mixture; and E. passing said air mixture in heat exchange relationship with combustion sustaining gas directed to said burner means.

13. The method of claim 12 including spacing the ladle from the burner wall by a distance which will result in exiting said products of combustion on the order of 25 to 40 feet/second hot velocity.

* * * * *